United States Patent [19]

Wells

[11] 4,280,429

[45] Jul. 28, 1981

[54] FLOATING BOAT STORAGE DRY DOCK

[76] Inventor: Edward R. Wells, 755 Hummingbird Way, No. 2, North Palm Beach, Fla. 33408

[21] Appl. No.: 14,209

[22] Filed: Feb. 22, 1979

[51] Int. Cl.[3] ..... B63C 1/02

[52] U.S. Cl. ..... 114/45; 114/263; 114/125; 405/3

[58] Field of Search ..... 114/331, 333, 121, 125, 114/45, 46, 47, 48, 49, 50, 51, 52, 53, 263, 264, 266, 267; 405/1, 4, 3

[56] References Cited

U.S. PATENT DOCUMENTS

| | | | |
|---|---|---|---|
| 1,043,411 | 11/1912 | Engstrand | 114/45 |
| 3,603,276 | 9/1971 | DeLisle | 114/263 |
| 3,991,695 | 11/1976 | McDonald | 114/45 |
| 4,018,179 | 4/1977 | Rutter | 114/45 |

*Primary Examiner*—Trygve M. Blix
*Assistant Examiner*—D. W. Keen
*Attorney, Agent, or Firm*—Malin & Haley

[57] ABSTRACT

A floating dry dock for a boat comprising a tubular, boat-supporting platform made from a planar array of interconnected PVC conduit (or similar material) and a pair of vertical, buoyant, tubular side walls connected to the platform. The dock includes an atmosphere venting system with its outlet above the water surface at all times connected to the base conduit platform and a freely positionable pump in fluid communication with the platform conduit array, which allows for the pumping of water into and out of the platform tubular array, which controls the depth level of the platform. The vertical side wall conduits are sealed and filled with air to add positive buoyancy to the platform to prevent it from sinking beyond a desired level. The diameter of each conduit of the ballasting tubular array for the platform is selected to accommodate boats of varying displacements. In operation, the device can be stored by floating adjacent a sea wall or the like. For loading a boat thereupon, the pump is initiated such that the platform conduits are flooded to sink the platform to a depth below the draft of the boat to be positioned in the water above the platform. After the boat is aligned directly over the platform, the pump is used to evacuate the water from the conduits in the platform, causing the entire platform to float, raising the boat therewith. The diameter of the side wall conduits (which are essentially filled with air and do not receive any ballast water) are selected in conjunction with the diameter of the platform conduit (which do receive ballasting water) such that the entire device can be adjustably buoyant to prevent deep submerging of the platform during the boat loading operation. Thus, the vertical side walls provide a variable buoyant force that increases as the platform submerges to control the depth of sinking of the dock.

2 Claims, 7 Drawing Figures

FLOATING BOAT STORAGE DRY DOCK

BACKGROUND OF THE INVENTION this invention relates to a floating dry dock for essentially dry storage of a small or medium sized boat which allows one to conveniently and quickly raise or lower a boat into or out of the water and specifically to provide a convenient storage dry dock for a boat which protects the hull by raising the boat out of the water.

Floating dry docks have been used in the past to accommodate large ships to allow people to clean or repair hull structure. Such devices have not been too practical for use with smaller vessels. The prior art dry docks disclosed have been extremely clostly in construction because of immense sizes, making the cost to use prohibitive for a small boat storage. Most small boat owners use slings, hoists, davits, or trailers for storing their boats out of water.

The present invention is extremely useful for a small boat owner to eliminate costly slings, hoists, and the inconvenience of trailering, by allowing for the dry storage of a boat inexpensively, yet quickly. The lightweight construction of the device further greatly reduces the cost of production.

BRIEF DESCRIPTION OF THE INVENTION

A floating dry dock including a boat supporting platform formed from a joined array of conduits in fluid communication, a pump for evacuating or flooding said platform conduit array, and buoyant vertical side barriers connected to said platform. The platform conduit array is vented to atmosphere by a vertical tube having an outlet that remains above the water surface at all times. The pump, when actuated in conjunction with suitable valves, is capable of pumping water into or out of the platform conduit array for ballasting the platform.

Along two parallel, opposite sides of the platform are a vertical array of air filled-sealed conduits which are connected to the ballastable platform. These conduits remain sealed and are not in any way connected with the pump or ballasting system. The vertical side barriers serve two functions, namely they act to provide safety rails on two sides while at the same time providing additional buoyancy that increases as the platform sinks.

In the construction of the floating storage dock, in one embodiment, polyvinyl chloride (PVC) conduit of a predetermined diameter may be utilized which will provide sufficient displacement buoyancy to support a boat of a particular displacement. Likewise, during the construction of the platform, threaded or slip fitted pipe joints such as T-Joints, 90 degree elbows and the like, are employed, joining the conduit together in an array. The slip fitted joints may be glued and/or welded by conventional methods. The vertical side barrier array may be likewise constructed. From the well known formula which deals with the weight of water and the volume displaced, the conduit network length and diameter can be adjusted to accommodate boats of specific lengths and weights, including motors.

A portable water pump is connected to the platform by removeable hoses. Suitable valves may be employed for proper ballasting.

To operate the device, which may be conveniently tied to a seawall, dock or other suitable place where it is desired to store the boat, the platform conduit are flooded with water by connecting and actuating the pump (or opening a valve) such that the platform will submerge to a depth below the draft of the boat to be mounted thereupon. Once submerged to the correct level, the boat is maneuvered to a position directly over the platform aligned with hull supports. The ballast flow is reversed by reversing the pump (or valves) evacuating water from the platform conduit array, forcing the platform to surface to a floating position in which the boat hull is completely out of the water. The boat may then be suitably lashed down to the platform and side barriers until ready to launch the boat again, which would be merely the reverse procedure.

A valve may be used which functions to change the direction of flow (in or out of the platform) without changing direction of the pump.

It is an object of this invention to provide an improved, low cost, highly efficient and relatively small and lightweight floating dry dock for storing vessels out of the water.

It is another object of this invention to provide a floating dry dock which can be constructed of readily available conduit and which is rigid and sturdy in construction and requires no maintenance.

In accordance with these and other objects which will be apparent hereinafter, the instant invention will now be described with particular reference to the accompanying drawings.

PREFERRED EMBODIMENT OF THE INVENTION

Figure 1:
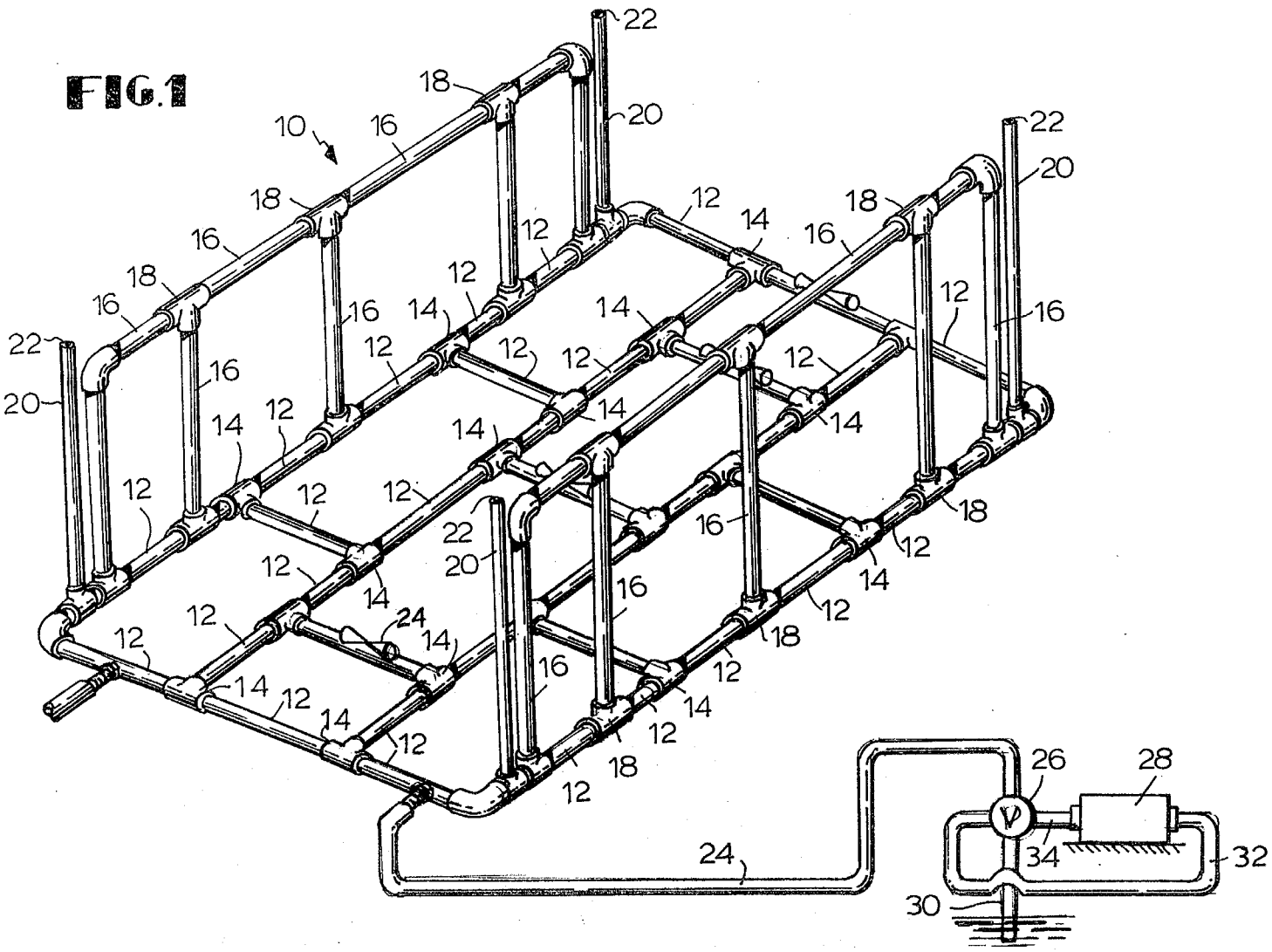
FIG. 1 shows a perspective view of the instant invention.
Figure 2:
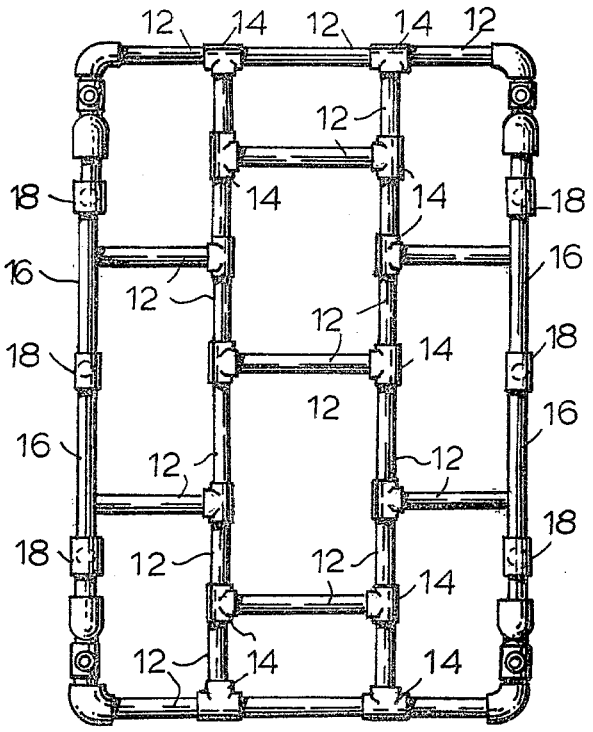
FIG. 2 shows a top plan view of the instant invention.

Referring now to the drawings and specifically FIG. 1, one embodiment of the present invention is shown generally at 10 comprised of a network of PVC conduits, such as 12, which are joined by T-shaped pipe joints 14 to form a ballastable platform for supporting a boat. The conduits may be screwed or slip-fitted together such that the conduits 12 from the support array which are all in fluid communication, allowing for the entire horizontal network of conduits 12 to be flooded. A pump 28 and valve 26 are connected to one end of the platform by a removeable hose 24, all of which is in fluid communication with the inside of the platform conduits 12.

The vertical barriers on each side are formed from conduits 16 and are connected together with T-shaped joints 18 as shown. The vertical conduits 16 have air in them and are sealed airtight at each T-joint 18 such as to not receive any water from the lower platform when the lower platform is filled.

Figure 3:
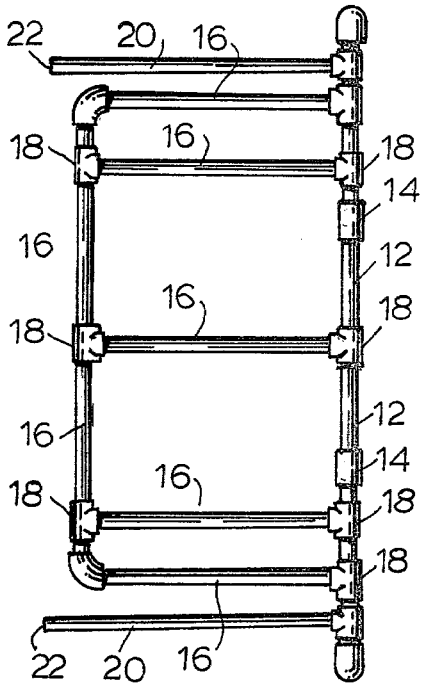
FIG. 3 shows a side elevational view of the instant invention.

FIG. 3 shows how the platform is formed with conduits 12 and T-joints 14 to form an array of conduits and joints substantially in a rectangular shape as shown. The central conduits may have barriers when the device is utilized with two pumps for added stabiity during flooding or evacuating such that one pump would flood or evacuate one side of the platform.

FIG. 3 shows a vertical side wall which includes conduits 18 connected together by T-joints 18, the ends having elbow joints 20. These are all joined to the platform conduit 12 but are not in fluid communication with the platform conduit.

Referring back to FIG. 1, a vent system, which includes a plurality of vent tubes 20 (one at each corner), having outlets 22 above the water surface at all times, is in fluid communication with the ballastable platform (conduits 12) so that proper venting takes place as water flows in or out of the platform conduits.

Figure 4:
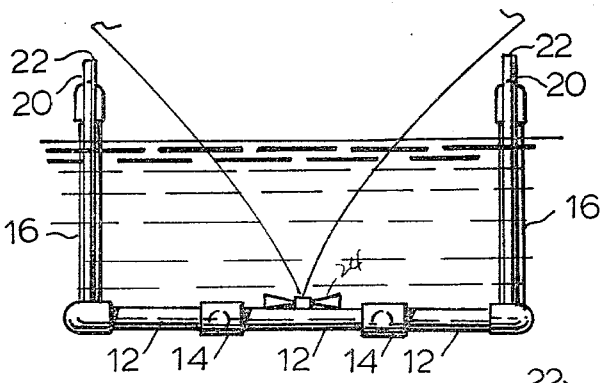
FIG. 4 shows a front elevational view of the instant invention during the loading of a vessel.
Figure 5:
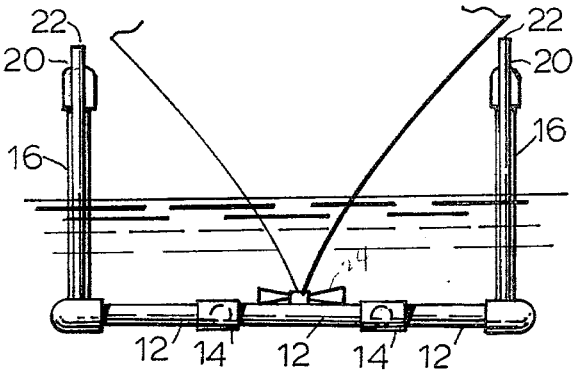
FIG. 5 shows the view of FIG. 4 with the vessel almost raised out of the water.

FIG. 4 shows how a boat is positioned on the device when flooded such that the platform is almost completely submerged, with only the upper vertical rails and the vent tube openings being disposed above the water line so that the boat may be positioned while floating over the top of the platform and aligned with the boat hull supports 24. Once aligned, the pump 28 is turned on, evacuating water from the platform which causes the entire platform to raise such as is shown in FIG. 5. Raising will continue until the boat hull is completely out of the water and the platform is floating.

Figure 6:
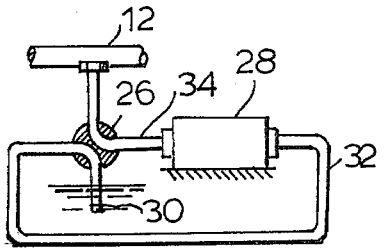
FIGS. 6 and 7 show schematic diagrams of the pump and valve in different modes of operation for filling or evacuating the platform.
Figure 7:
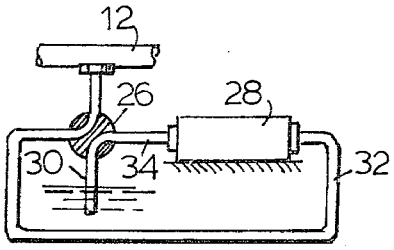

FIGS. 6 and 7 show the pump and valve which may be used with the present invention for flooding or evacuating the platform. Please note that even though only one pump is shown, two or even four pumps could be used in combination with the valve shown, one at each corner, such that the device can be flooded more evenly to keep the platform level at all times. Further, a leveling switch, such as a mercury switch, may be mounted along the center of the platform which would turn off a particular pump should the platform become unlevel so that the opposite side that is raised would continue flooding until the platform is level again. FIG. 6 shows a pump configuration in which valve 26 is connected by hose 34 to pump 28, the output of the pump being connected to conduit 32 which connects back into the valve and to conduit 30. Conduit 30 is disposed into the body of water. Conduit segment 12 represents the end of the platform. The pump is oriented to pump into conduit 32 as shown. The embodiment shown in FIG. 6 is to evacuate water from the platform and the valve 26 is oriented so that water will flow from conduit 12 into the valve into conduit 34 where the pump discharges it again through the valve into conduit 30, dumping it into the body of water. In FIG. 7, the valve need only be rotated 90 degrees to change the direction of flow even though the pump direction is not changed. As shown in FIG. 7, water is taken from the body of water into conduit 30 through valve 26 and into conduit 34 where it is pumped again by pump 28 into conduit 32 back into the valve and into the platform for flooding the platform. Thus, with this valve and a 90 degree movement of the valve in conjunction with a single direction pump, the system may either be evacuated or flooded, depending on the position of the valve.

The instant invention has been shown and described herein in what is considered to be the most practical and preferred embodiment. It is recognized, however, that departures may be made therefrom within the scope of the invention and that modifications will occur to a person skilled in the art.

What I claim is:

1. A floating dry dock for storing a small vessel out of water comprising:

a base, said base formed in a flat plane, said base including a plurality of cylindrical conduits of substantially the same diameter joined together to form a substantially rectangular base periphery, said conduits being in fluid communication with each other, said base including at least two intermediately disposed conduits joining opposite sides and in the plane of said base peripheral conduits, said intermediate conduits being in fluid communication with said peripheral conduits;

a boat hull supporting means connected to at least one of said intermediate conduits for engaging a boat hull and supporting a boat in an upright position on said base;

a first vertical array of conduits connected at one end to one side of said base forming a first side railing, said first vertical conduit array being sealed and having air for buoyancy;

a second vertical array of conduits, each connected at one end to the opposite side of said base across from said first railing, the second vertical conduit array forming a second side railing, said first and second vertical conduit arrays being substantially parallel;

means in fluid communication with said base for filling or emptying said base with water; and a venting means in fluid communication with said base for allowing venting of said base for the filling emptying of water therefrom.

2. A floating dry dock as in claim 1, wherein:

said conduits are made of a PVC type material.

* * * * *